US005487481A

United States Patent [19]

Sander et al.

[11] Patent Number: 5,487,481

[45] Date of Patent: Jan. 30, 1996

[54] TAMPER EVIDENT PLASTIC CLOSURE

[76] Inventors: Dieter Sander, 315 Watline Avenue, Mississauga Ont., Canada, L4Z1P3; Uwe F. Meyer, 50 Meadowbank Road, Islington Ont., Canada, M9B5C8

[21] Appl. No.: 332,589

[22] Filed: Oct. 31, 1994

[51] Int. Cl.[6] ..... B65D 39/00

[52] U.S. Cl. ..... 215/252; 215/344

[58] Field of Search ..... 215/252, 344, 215/345

[56] References Cited

U.S. PATENT DOCUMENTS

| | | | |
|---|---|---|---|
| 4,143,785 | 3/1979 | Ferrell | 215/270 |
| 4,505,401 | 3/1985 | Berglund | 215/252 |
| 4,613,052 | 9/1986 | Gregory et al. | 215/252 |
| 4,664,278 | 5/1987 | Barriac . | |
| 4,828,127 | 5/1989 | Young et al. | 215/252 |
| 4,846,361 | 7/1989 | Haffner | 215/252 |
| 4,971,212 | 11/1990 | Kusz . | |
| 5,004,112 | 4/1991 | McBride . | |
| 5,131,550 | 7/1992 | Thompson . | |
| 5,137,163 | 8/1992 | Moore . | |
| 5,215,204 | 6/1993 | Beck et al. . | |
| 5,242,068 | 9/1993 | McCandless . | |
| 5,356,020 | 10/1994 | Thompson | 215/252 |

*Primary Examiner*—Allan N. Shoap
*Assistant Examiner*—Stephen Cronin
*Attorney, Agent, or Firm*—Harpman & Harpman

[57] ABSTRACT

A tamper evident plastic closure for containers and the like. The closure has a top portion and a depending annular skirt portion with a annular ring attached to the closure by a plurality of frangible elements. The annular ring includes a plurality of circumferentially spaced radially inwardly extending projections arranged for registration with a locking flange on the associated container for separation of the annular ring from the closure skirt upon removal of the closure indicating tampering thereto.

8 Claims, 2 Drawing Sheets

TAMPER EVIDENT PLASTIC CLOSURE

BACKGROUND OF THE INVENTION

1. Technical Field:

This device relates to container closures that indicate the removal of the closure and replacement of the closure by separation of a tamper evident ring on the closure.

2. Description of Prior Art

Prior art devices of this type have relied on a variety of different closure and container configurations to indicate when a closure has been tampered with, see for example U.S. Pat. Nos. 4,664,278, 4,971,212, 5,004,112, 5,131,550, 5,137,163, 5,215,204 and 5,242,068.

In U.S. Patent ending in 278 a tamper indicating package is disclosed defining a container having an external threaded neck and an annular retaining bead therebelow, the closure having the tamper indicating band secured to the main body of the closure by a plurality of frangible elements positioned between oppositely disposed spaced integral support extending from the tamper evident band.

In U.S. Patent ending in 212 a tamper indicating package is disclosed comprising a container having a finish with external threads thereon and a plastic closure having segmented internal threads, a tamper indicating band with a plurality of retaining cams positioned thereon for registration with the container's neck portion.

In U.S. Patent ending in 112 a tamper indicating plastic closure is shown having segmented internal spiral threads on a depending annular flange from a top portion and a tamper evident band secured to the depending flange by a plurality of frangible elements. The band has a number of flexible projections positioned circumferentially about its inner surface for engagement against registering projections on the closure.

Referring to U.S. Patent ending in 550, a closure for containers is illustrated and described in which a cap portion has a tamper indicating band secured thereto by a plurality of frangible elements interconnecting same with the cap portion, the tamper evident band has a plurality of circumferentially spaced locking elements as well as an area of reduced transverse dimension allowing for flexibility of the band for initial insertion onto the container.

Referring now to U.S. Patent ending in 163 a tamper evident closure with ramped contact is disclosed in which a cap portion has a frangible band secured to its bottom perimeter edge by a plurality of frangible elements. The band has an annular shoulder which engages upon a corresponding registration point on the container so that rotation of the cap forces the separation of the tamper band from the closure element by breaking of the frangible sections.

Referring now to U.S. Patent ending in 204 a tamper evident closure with hinged band is disclosed in which a cap portion has a tamper evident band secured from its bottom perimeter edge by a plurality of frangible elements with a flexible hinge extending from the tamper evident band to the closure so that upon rotation and separation of the band from the cap, the cap will remain attached to the tamper band via the flexible hinge.

Finally, in U.S. Patent ending in 068 a tamper indicating plastic closure is disclosed which has a cap portion and a tamper evident band secured thereto by a plurality of frangible elements. The tamper evident band has a series of inwardly extending flexible projections which provide for selective one-way rotation of the cap for removal engaging a portion of the container and separating the frangible elements upon attempt to remove the cap.

SUMMARY OF THE INVENTION

A tamper evident closure having a detachable annular ring removably secured to a depending annular skirt. The closure is internally threaded for registration on a threaded neck portion of a container. The detachable annular ring includes a plurality of spaced inwardly extending projections and multiple frangible elements interconnecting the annular ring with the depending skirt which will indicate removal of the closure by separation of the band from the skirt upon rotation of the closure.

DESCRIPTION OF THE PREFERRED EMBODIMENT

Figure 6:
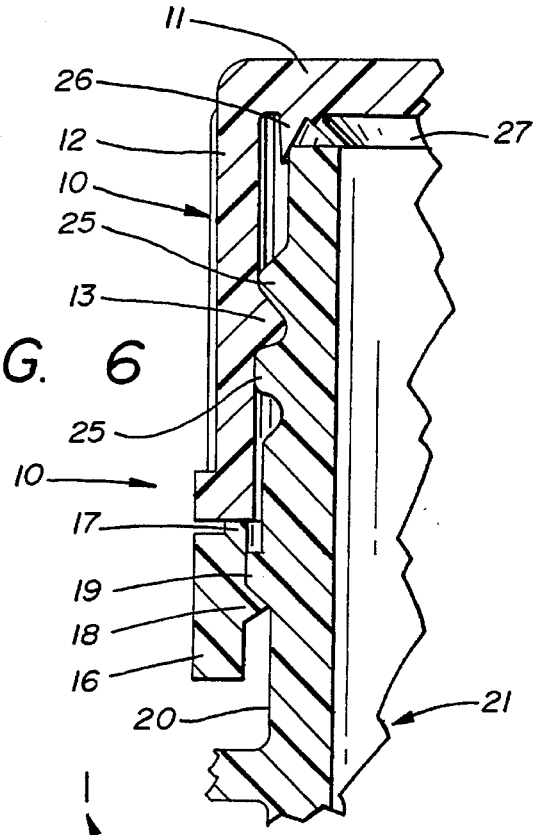
FIG. 6 is an enlarged partial cross-sectional view of the closure on a container.

Referring to FIGS. 1–6 of the drawings, it will be seen that a closure 10 is shown having a top portion 11 and a depending annular skirt 12 extending therefrom. The depending annular skirt 12 has a segmented inwardly extending spiral thread 13 formed on its interior annular surface 14 with each of the threaded segments being aligned in spaced vertical relation to one another defining spaced parallel threaded segment pairs extending about a portion of the internal annular surface 14 terminating adjacent the perimeter free edge at 15 of said depending annular skirt 12. A frangible annular ring 16 is integrally molded to said depending annular skirt 12 by interconnecting frangible elements 17 extending therebetween. The annular ring 16 has a plurality of circumferentially spaced inwardly facing arcuate projections 18 arranged to register with an annular outwardly extending locking flange 19 on a neck portion 20 of a container 21 as seen in FIG. 6 of the drawings. The annular ring 16 is flexible for initial insertion of the closure 10 on the neck portion 20 as will be well known and understood by those skilled in the art.

Figure 1:
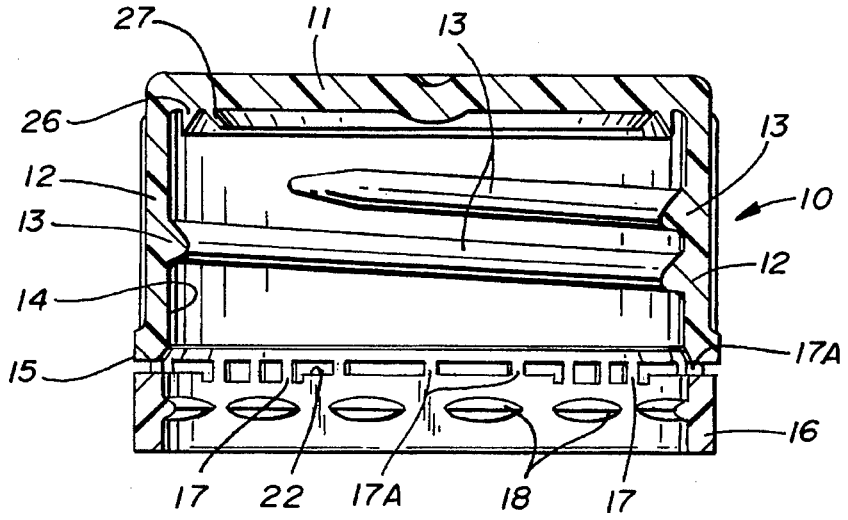
FIG. 1 is a sectional view of the closure on lines 1—1 of FIG. 5.
Figure 2:
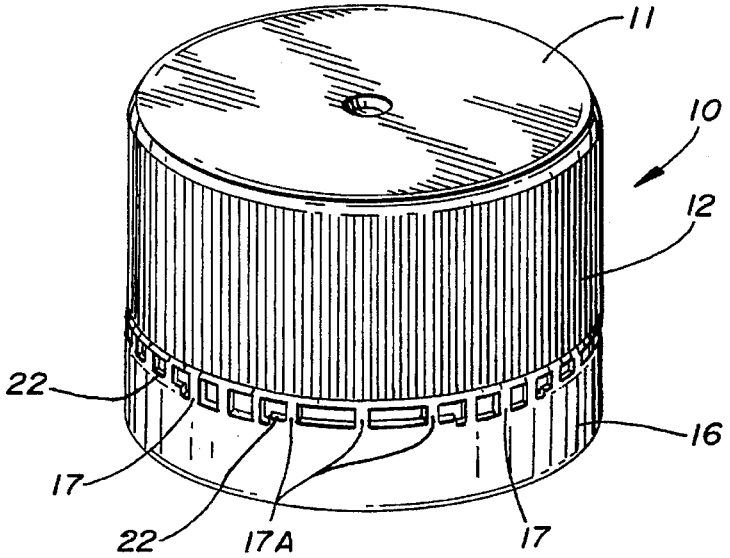
FIG. 2 is a perspective view of the closure before positioning on a container.
Figure 3:
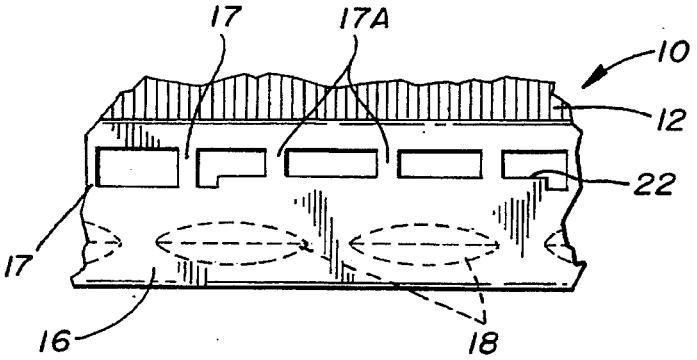
FIG. 3 is an enlarged elevational view of a portion of the closure.
Figure 4:
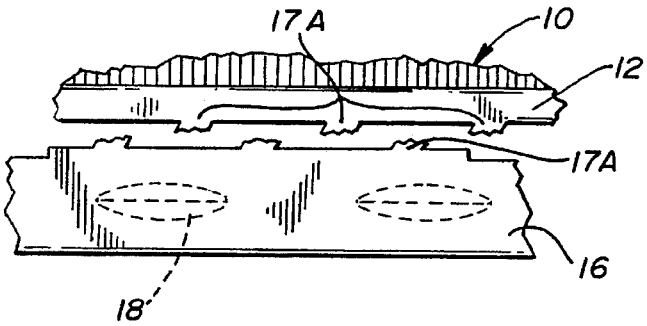
FIG. 4 is an enlarged elevational view of illustrating rotation of the closure and separation of the tamper evident band therefrom.

Referring now to FIGS. 1, 3, and 4 of the drawings, it will be seen that the annular ring 16 has a series of circumferentially spaced elevated bridge areas 22 extending therefrom towards the annular skirt 12 to which it is secured as hereinbefore described. Each of said elevated bridge areas 22 defines a reinforcing support for the annular ring 16 during molding and insertion of the closure 10 on the bottle neck portion 20 as will be discussed in greater detail hereinafter. The frangible elements 17A extend from the annular ring 16 between said elevated bridge areas 22. It should be noted that some of the arcuate projections 18 are in a vertically aligned relation with the respective elevated bridge areas 22 and with the frangible elements 17 therebetween. Each of the bridge areas 22 provide support for the frangible elements 17 and 17A during the closure capping process on the bottle neck portion by preventing excessive vertical deformation and movement of the ring against the depending skirt 12 which would otherwise break the frangible elements 17 prematurely. The elevated bridge areas 22 act as stops against the skirt 12, the same protection of the annular ring 16 is apparent during demolding of the closure 10 at a time when the frangible elements 17 can be readily damaged when stripped from the mold.

The closure spiral thread 13 engages a registering spiral thread 25 extending outwardly from the neck portion 20 a known distance as seen in FIG. 6 of the drawings. The resulting action of the closure rotation counter-clockwise for removal twists and elevates the closure on the neck portion deforming and breaking the respective frangible elements 17 separating the annular ring 16 from the depending annular skirt 12.

Figure 5:
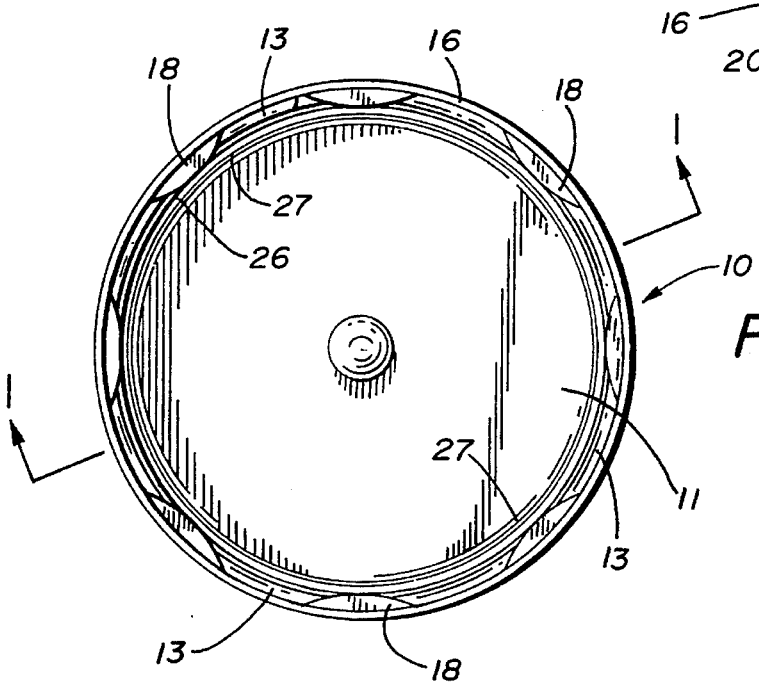
FIG. 5 is a bottom plan view of the closure.

By referring to FIG. 5 of the drawings, the closure 10 can be seen wherein the relative positioning of the hereinbefore described spiral thread 13 and the arcuate projections 18 on the annular ring 16 can be seen in a circumferentially spaced overlapping relationship providing for even offsetting points of engagement with their respective registering counter parts of the locking annular flange 19 on the neck portion 20 and the spiral thread 25 on the neck portion 20 respectively.

Referring now to FIG. 1 of the drawings, a first annular depending sealing flange 26 extends downwardly from the closure's top portion 11 in spaced relation to the depending annular skirt 12. A second sealing flange 27 of a known length extends angularly and inwardly from said top portion 11 adjacent said first sealing flange 26 defining a multiple sealing configuration for engagement with the neck portion 20 of the container 21 hereinbefore described.

It will be evident from the above description that the tamper evident closure of the invention is characterized by the positioning of the elevated bridge areas 22 on the ring 16 and the spaced frangible elements 17 extending from elevated bridge areas and the ring 16 between elevated bridge portions 22 to the depending annular skirt 12 which during annular rotation of the closure during removal separates from the ring 16 allowing the closure 10 to be removed from the neck portion 20 leaving the tamper evident ring thereon.

It will thus be seen that a new and improved tamper evident plastic closure has been illustrated and described that combines the multiple sealing features of a twist off closure with a tamper indicating ring that remains on the container after initial rotation of the closure on the container takes place.

It will be apparent to those skilled in the art that various changes and modifications may be made therein without departing from the spirit of the invention, therefore I claim:

We claim:

1. A tamper evident closure comprising a top portion, an annular depending skirt extending therefrom, a tamper indicating ring connected to said depending skirt by a plurality of circumferentially spaced frangible elements, said tamper indicating ring having a plurality of annularly spaced elevated bridge portions thereon extending axially towards said depending skirt, the elevated bridge portions defining areas of decreased ring spacing from said depending skirt, some of said frangible elements extending from said elevated bridge portion to said depending skirt, said tamper indicating ring including circumferentially spaced inwardly facing arcuate projections and an internal spiral thread on said depending skirt.

2. The tamper evident closure set forth in claim 1 wherein each of said arcuate projections on said tamper indicating ring are circumferentially aligned in vertical spaced relation to said elevated bridge portions of said tamper indicating ring.

3. The tamper evident closure set forth in claim 1 wherein segments of said spiral thread on said depending skirt are in spaced vertical overlapping annular offset alignment with said arcuate projections on said tamper indicating ring.

4. The tamper evident closure set forth in claim 1 wherein said elevated bridge portions extending from said annular ring are of a known vertical height, and said frangible elements between said elevated bridge portions are of a height greater than that of said known height of said elevated bridge portions,

5. A tamper indicating closure for a container having a neck with an external thread and an annular locking flange therebelow, said closure comprising a plastic body having a top portion, a depending annular skirt and a tamper indicating ring connected to said depending annular skirt by a plurality of frangible elements, circumferentially spaced elevated bridge portions extending from said tamper indicating ring, said frangible elements extending from said tamper indicating ring between and from said elevated bridge portions, interconnecting with the free edge of the peripheral skirt, said elevated bridge portions of the tamper indicating ring defining areas having reduced vertical spacing from said peripheral skirt, a plurality of annularly spaced arcuate projections extending inwardly from said tamper indicating ring registerable with said container locking annular flange.

6. The tamper indicating closure set forth in claim 5 wherein said elevated bridge portions extending from said tamper indicating ring are of a known vertical height and said frangible elements between said elevated bridge portions are of a height greater than that of said known height of said elevated bridge portions.

7. The tamper indicating closure set forth in claim 5 wherein segments of said spiral threads on said depending skirt are in spaced vertical alignment and in overlapping annular alignment with said arcuate projections on said tamper indicating ring.

8. The tamper indicating closure set forth in claim 5 wherein each of said arcuate projections on said tamper indicating ring are circumferentially aligned in vertical spaced relation to said elevated bridge portions of said tamper indicating ring.

* * * * *